United States Patent [19]

Bullock

[11] Patent Number: 4,908,244

[45] Date of Patent: Mar. 13, 1990

[54] ORNAMENTAL HOLIDAY DECORATION

[75] Inventor: Rose S. Bullock, Rochester, Mich.

[73] Assignee: Charles B. Bullock, Bloomfield Hills, Mich.

[21] Appl. No.: 322,629

[22] Filed: Mar. 13, 1989

[51] Int. Cl.[4] ..... A47G 33/06

[52] U.S. Cl. ..... 428/8; 156/61; 211/205; 428/18

[58] Field of Search ..... 428/6, 18, 8, 19, 20; 211/205; 156/61; 362/123

[56] References Cited

U.S. PATENT DOCUMENTS

| | | | |
|---|---|---|---|
| 2,325,191 | 7/1943 | Mortimer | 428/11 X |
| 2,801,107 | 7/1957 | Greer, Jr. | 428/20 X |
| 3,549,465 | 12/1970 | Skelley, Jr. | 428/11 |
| 4,493,862 | 1/1985 | Albert et al. | 428/10 |

*Primary Examiner*—Henry F. Epstein

*Attorney, Agent, or Firm*—Harness, Dickey & Pierce

[57] ABSTRACT

An ornamental device and a kit therefor. In the preferred embodiment, layers of ornamental balls with progressively decreasing diameters are threaded down a shaft and nested together to simulate a Christmas tree. The kit may further include a protective support having pockets for receiving the various balls, base, shaft and decorative pinnacle for the device.

14 Claims, 2 Drawing Sheets

ORNAMENTAL HOLIDAY DECORATION

BACKGROUND OF THE INVENTION

1. Technical Field

This invention relates to ornamental devices and, more particularly, to a method of assembling such devices from elements contained in a kit, as well as the resulting device.

2. Discussion

A wide variety of holiday decorations and kits for making such decorations are generally known. A few examples of ornamental assemblies found in the patent literature include U.S. Pat. No. 2,325,191 to Mortimer and U.S. Pat. No. 4,493,862 to Allbert et al. The '862 patent generally relates to a method for assembling novel ornamental articles of relatively large size for decorative purposes and occasions, such as for use as Christmas or other holiday decorations in the home, office, restaurants, etc. or for use as reflective decorations in dance halls or similar places. The '191 patent relates to a device having a plurality of relatively small objects supported in a decorative manner such that light diffusion and reflection are utilized to enhance the attractive and decorative effect. Both of these prior approaches, however, appear to be unduly complex and costly. In addition, they do not lend themselves to being easily assembled, disassembled and stored in an efficient yet protective manner.

SUMMARY OF THE INVENTION

In accordance with the teachings of the present invention, an ornamental device is provided that is aesthetically pleasing yet relatively simple to assemble, disassemble and store. To this end, a plurality of layers of ornamental devices are stacked on top of each other to simulate a given shape such as a Christmas tree. In the preferred embodiment, each element is in the form of a hollow ball commonly used to decorate real Christmas trees. These balls have a cap with a loop extending therefrom that is ordinarily coupled to a hook for hanging the ball on a live tree. In the present invention, however the loops are threaded onto a vertically extending shaft supported by a base. The balls are of various cross-sectional dimensions and arranged so that the balls on each layer are progressively decreasing in size from the bottom to top layer. The top of the shaft may be covered by a suitable elongated hollow decorative element.

The device is easily disassembled by sliding the various elements off of the shaft, disconnecting the shaft from the base and storing them in a suitable protective receptacle having pockets therein for receiving the elements and protecting them.

BRIEF DESCRIPTION OF THE DRAWINGS

The various advantages and features of the present invention will become apparent upon reading the following specification and by reference to the drawings in which.

DESCRIPTION OF THE PREFERRED EMBODIMENT

Figure 1:
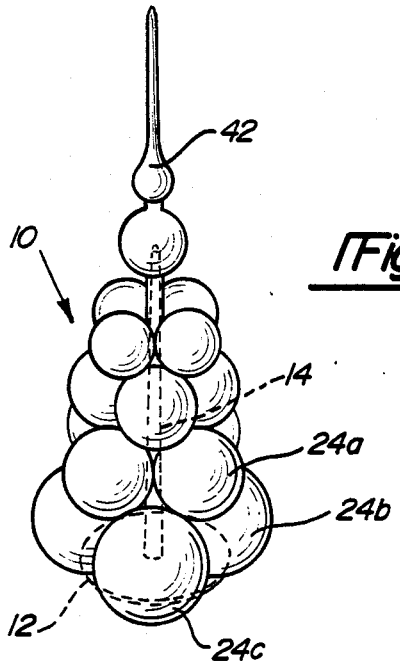
FIG. 1 is a perspective view of an ornamental device made in accordance with the teachings of the present invention.

Turning now to FIGS. 1–4, the ornamental device 10 includes a base 12 and a shaft 14 removably attached thereto. While the base 12 can take a variety of forms, it preferably takes the shape of a disc having a marginal flat flange portion 16 and a raised dome portion 18 in the central area thereof. The center of the dome 18 includes a receptacle for the lower end of the shaft 14 which is in the form of a thickened area or boss 20 with a stepped counter bore 21 extending therethrough. In the preferred embodiment, a conventional knitting needle is used for shaft 14 and the lower portion of the counter bore 21 is shaped to receive the head 23 of the needle. The upper portion of the counter bore 21 opens into an aperture 25 having a diameter smaller than the shaft of the needle. The base 12 is preferably made of plastic or other suitable material that yields sufficiently to create a press fit between the shaft 14 and aperture 25. Thus, the shaft 14 is removably connected to the base 12 by sliding the top of the needle upwardly through the counter bore/aperture in the open-bottomed base until the head 23 nests in the counter bore 21 and the shaft 14 is press fit into the aperture 25.

The ornamental device 10 includes a plurality of layers of ornamental elements. In the preferred embodiment the ornamental elements take the form of conventional hollow glass decorative balls. These decorative balls could also be of a solid nature such as those that are covered with a satin-like material but are otherwise essentially in the same configuration as that of conventional hollow glass decorative balls. Each ball is characterized by a generally spherical body 24 having a neck portion 26 protruding therefrom. A metallic cap 28 fits over the end of the neck 26. A spring member having legs 30 and an outer loop 32 is used in a conventional manner to maintain the cap 28 onto the neck 26. Ordinarily, the loop 32 is used to engage hooks (not shown) for hanging the balls in the traditional manner from a live or artificial tree. However, the present invention utilizes the balls without the hooks to form the majority of the ornamental device 10.

Figure 2:
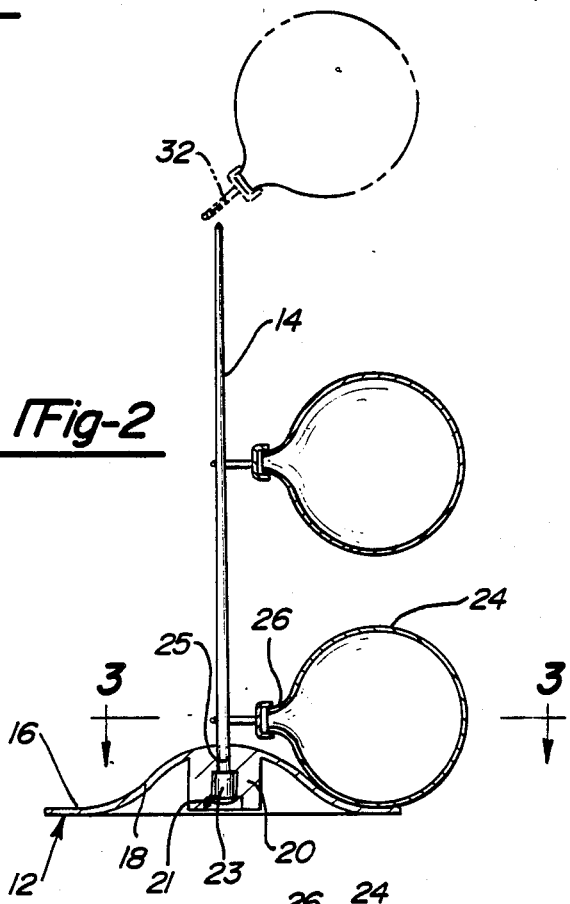
FIG. 2 is a side view illustrating the threading of the ornamental balls onto to the shaft.
Figure 3:
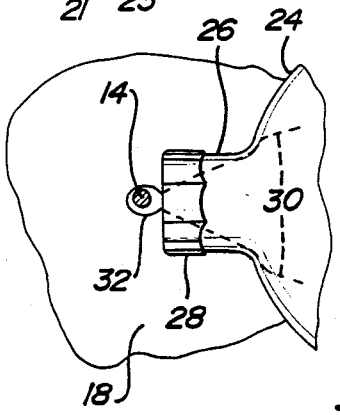
FIG. 3 is a cross-sectional view taken along the lines 3—3 of FIG. 2.
Figure 4:
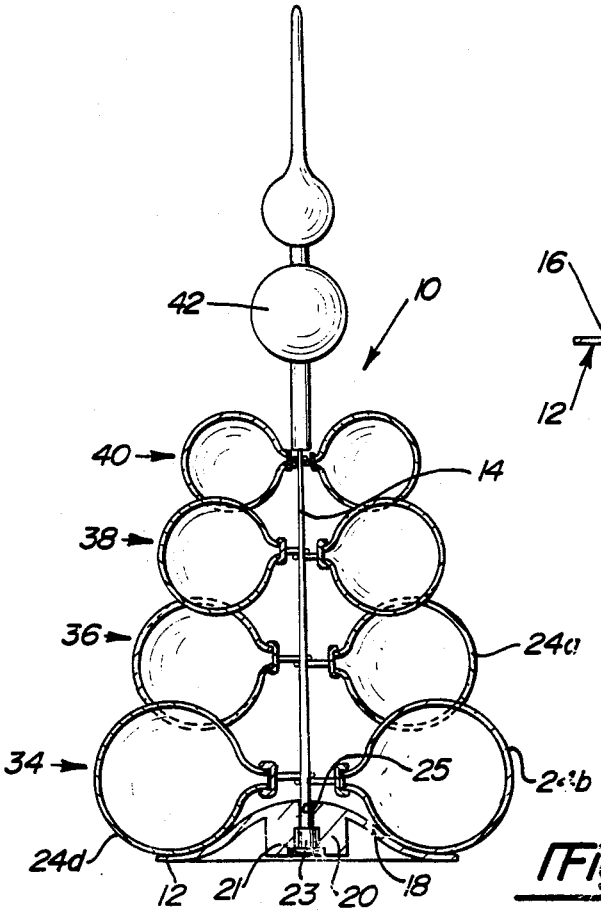
FIG. 4 is a cross-sectional view of the assembled device which simulates a Christmas tree.

As shown in FIGS. 2 and 4, the device 10 is assembled by threading the loop 32 over the shaft 14 and sliding the balls downwardly along the length of the shaft. The loop 32 thus slidably holds the balls onto the shaft 14 such that the plane of the loop 32 is generally transverse to the longitudinal axis of the shaft 14; i.e., so that the neck 26 extends radially outwardly in the horizontal plane. The lowermost layer 34 consists of a plurality of balls 24 having a given cross-sectional dimension, here diameter. In the specifically disclosed embodiment, there are four balls evenly distributed about the shaft 14. Then, the next layer 36 of balls are threaded onto shaft 14. The balls in layer 36 have a smaller diameter than the balls in layer 34. A like number of balls are used in all of the layers. As a result, each layer of balls is offset so that the balls nest in the valleys defined by adjacent balls of adjacent layers. For example, as shown in FIGS. 1 and 2, ball **24*a* of layer 36 nests between larger balls 24*b* and 24*c* of the lowermost layer 34. As a result, there is provided a very compact, dense shape which substantially hides the shaft 14**.

Upper layers 38 and 40 are similarly threaded onto shaft 14 and nested between adjacent layers. Then, an ornamental pinnacle 42 can be used to cover the free end of shaft 14. Thus, the ornamental device 10 with its nested layers of balls with progressively decreasing diameters cooperate with the pinnacle 42 or other suitable covering such as a star shape to simulate a Christmas tree. Each of the elements is relatively inexpensive, simple to make and assemble yet they cooperate to provide very aesthetically pleasing ornamentation. To disassemble the device 10 after the holidays are over, the assembly steps are merely reversed.

Figure 5:
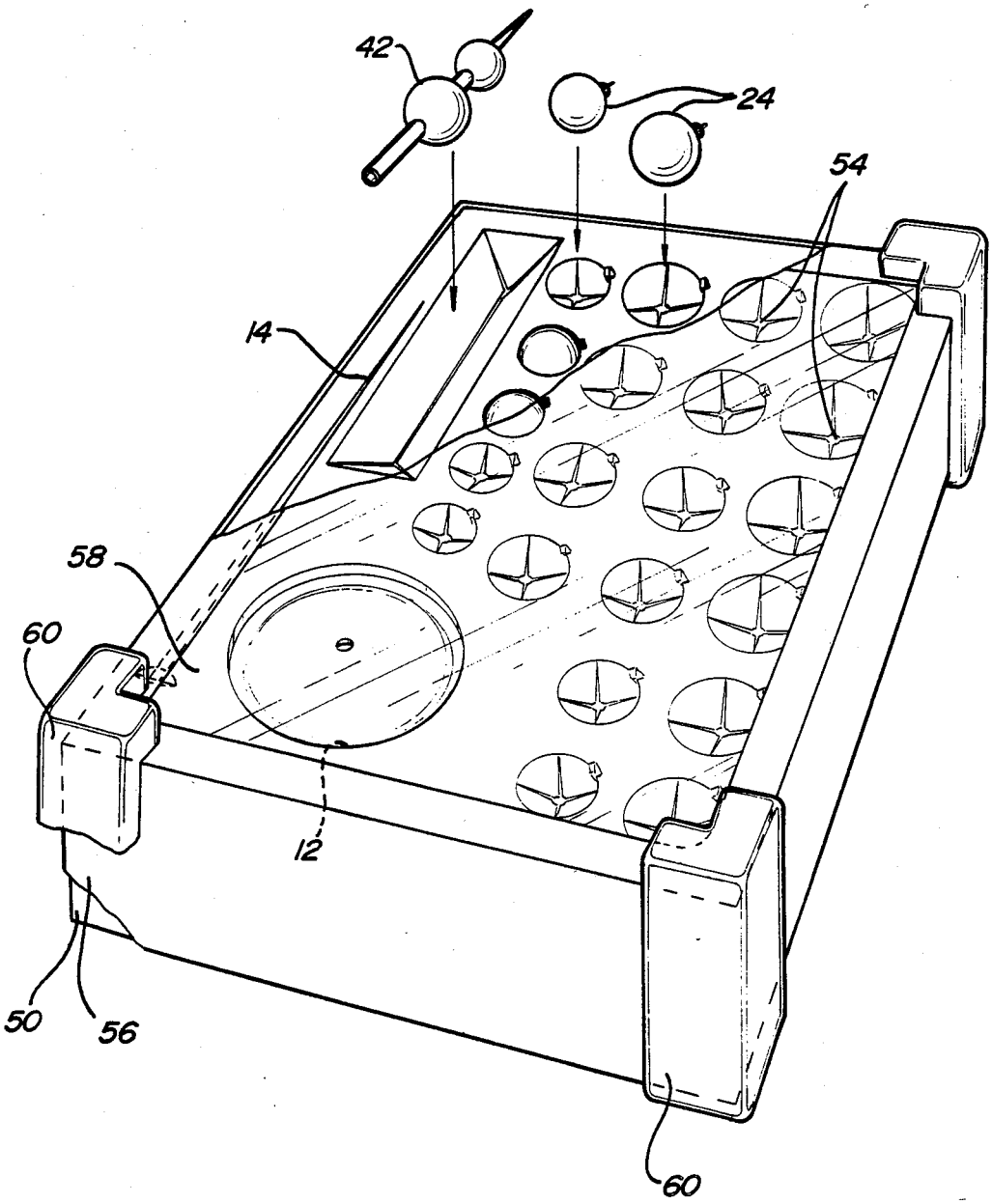
FIG. 5 is a perspective view of a package construction forming a kit for making the decorative device.

Turning now to FIG. 5, each of the elements can be packaged and stored in a kit form. The kit would preferably include a support 50 formed of foam or suitable cardboard box enclosure having a plurality of pockets 54 in an upper surface thereof. The pockets 54 would be in substantially the same shape as the elements of the ornamental device 10. Thus, each of the elements can be nested into the pockets 54 and protected by the resilient nature of the support 50. For marketing purposes, the support 50 could bear suitable indicia such as the trademark of the product, the size, i.e. assembled height of the ornamental device, name of manufacturer, etc. A cover 56 having a clear plastic window 58 can be used to complete the package. The transparent nature of the box cover 56 allows the potential buyer/user to view the size, color and aesthetic characteristics of the elements which make up the ornamental device 10. For shipping and/or storing purposes, the aforementioned display carton would then be fitted using devices such as protective corners 60, into an appropriately sized corrugated box to which is affixed a proper identification means which will identify the contents therein, i.e., (1), (2) or more kits of a certain height and color combination.

It should be understood that while this invention was described in connection with a specific example, that those skilled in the art will realize that other modifications can be made without departing from the spirit of the invention after having the benefit of studying the specification, drawings and following claims. For example, the height of the shaft 14 or pinnacle 42 and number of ball layers can be varied as desired.

What is claimed is:

1. An ornamental device comprising:

a base;

a shaft having a lower end removably connected to the base and an upper end; and a plurality of decorative elements each having a loop extending therefrom, the elements being successively threaded onto the shaft such that the loop slidably holds the elements onto the shaft, the elements being arranged in a plurality of stacked layers, a lowermost layer having elements of a given cross-sectional dimension while elements of upper layers are of different cross-sectional dimensions to thereby simulate a given shape.

2. The device of claim 1 wherein the decorative elements are balls.

3. The device of claim 2 wherein the layers comprise balls of progressively decreasing diameter so that the balls of adjacent layers nest together to form a compact shape simulating a Christmas tree.

4. The device of claim 3 which further includes:

a decorative hollow elongated element covering the upper end of the shaft.

5. The device of claim 1 wherein said base comprises:

a disc having a generally flat marginal flange and a raised central dome, the dome including a receptacle therein having an aperture into which the lower end of the shaft is press fit.

6. An ornamental device simulating a Christmas tree comprising:

a base in the form of a disc having a marginal flange and a raised central dome, the dome further including a receptacle;

a knitting needle having its lower end removably connected to the receptacle in the base;

a first layer of hollow, ornamental balls each having a given diameter and a neck portion covered by a cap, each ball further including a spring member having internal legs and an external loop, the balls of the first layer being threaded over the shaft so that the loops slidably hold the balls onto the shaft adjacent the base, with the plane of the loop being substantially transverse to the shaft;

a second layer of balls of smaller diameter than the first layer, the balls of the second layer nesting in valleys defined by adjacent balls of the first layer;

a third layer of balls of a diameter smaller than the balls of the second layer, the balls of the third layer nesting in valleys defined by adjacent balls of the second layer;

a fourth layer of balls having a diameter smaller than the diameter of the balls of the third layer, the balls of the fourth layer nesting in valleys defined by adjacent balls of the third layer; and a decorative pinnacle covering the upper end of the needle and cooperating with the layers of balls to simulate a Christmas tree.

7. A method of assembling an ornamental device simulating a Christmas tree:

attaching an elongated shaft to a base;

sliding a first plurality of balls having loops thereon down the shaft so that the loops slidably hold the balls onto the shaft and form a first layer of balls surrounding the shaft;

sliding a second plurality of balls down the shaft so that the loops thereof slidably hold the balls onto the shaft, the second layer of balls having a lesser diameter than the diameter of the balls of the first layer and being nested in valleys defined by adjacent balls of the first layer;

sliding at least a third plurality of balls down the shaft, the third plurality of balls having a lesser diameter than the diameter of the balls of the second layer and being nested in valleys defined by adjacent balls of the second layer; and sliding a hollow pinnacle over the upper end of the shaft such that the ornamental device simulates a Christmas tree.

8. A kit for an ornamental device, said kit comprising:

a support for carrying and protecting the following components:

a base;

a shaft removably connectable to the base;

a first plurality of ornamental balls each having a loop extending therefrom;

a second plurality of balls having a lesser diameter than the diameter of the first plurality of balls;

at least a third plurality of balls of a diameter less than the diameter of the balls of the second plurality; and whereby the shaft can be removed from the support and connected to the base and, thereafter, the first, second and third plurality of balls can be successively threaded down the shaft and nested between adjacent layers to simulate a Christmas tree.

9. The kit of claim 8 which further includes a hollow elongated ornamental element for covering the upper end of the shaft.

10. The kit of claim 9 which further includes a cover for the support and being sufficiently transparent so that a prospective buyer can view the components of the kit.

11. The kit of claim 9 wherein the support is made of resilient material having pockets formed in a surface thereof for receiving the component.

12. The kit of claim 11 wherein the support is made of a preformed cardboard box.

13. An ornamental device comprising:

a base;

a vertically disposed shaft having a lower end removably connected to the base and an upper end; and a plurality of decorative elements, each having a loop extending therefrom, the elements being successively threaded onto the vertically disposed shaft such that the loop slidably holds the elements adjacent to the shaft, the elements being arranged in a plurality of stacked layers, so that decorative elements in a given layer support the weight of decorative elements in higher layers.

14. The device of claim 13, wherein the layers of decorative elements nest together to substantially conceal the vertically disposed shaft from view.

* * * * *